US012384615B2

(12) United States Patent
Hudson et al.

(10) Patent No.: US 12,384,615 B2
(45) Date of Patent: Aug. 12, 2025

(54) FLUID DISPENSING METHOD AND APPARATUS

(71) Applicant: SWIMC LLC, Cleveland, OH (US)

(72) Inventors: Richard D. Hudson, Warrensville Heights, OH (US); James J. Johnson, Warrensville Heights, OH (US); Thomas W. Williams, Cleveland, OH (US)

(73) Assignee: SWIMC LLC, Cleveland, OH (US)

( * ) Notice: Subject to any disclaimer, the term of this patent is extended or adjusted under 35 U.S.C. 154(b) by 48 days.

(21) Appl. No.: 17/918,133

(22) PCT Filed: Apr. 30, 2021

(86) PCT No.: PCT/US2021/030338
§ 371 (c)(1),
(2) Date: Oct. 11, 2022

(87) PCT Pub. No.: WO2021/222859
PCT Pub. Date: Nov. 4, 2021

(65) Prior Publication Data

US 2023/0132918 A1 May 4, 2023

Related U.S. Application Data

(60) Provisional application No. 63/018,413, filed on Apr. 30, 2020.

(51) Int. Cl.
*B65D 83/20* (2025.01)
*B65D 83/16* (2006.01)
(Continued)

(52) U.S. Cl.
CPC ..... *B65D 83/20* (2013.01); *B65D 83/164* (2025.01); *B65D 83/32* (2013.01); *B65D 83/382* (2013.01); *B65D 83/70* (2013.01)

(58) Field of Classification Search
CPC .... B65D 83/205; B65D 83/207; B65D 83/32; B65D 83/382; B65D 83/70
See application file for complete search history.

(56) References Cited

U.S. PATENT DOCUMENTS 1,899,222 A * 2/1933 Werder ..... B65D 83/207 239/375
2,271,715 A * 2/1942 Saffell ..... F16K 21/04 251/303
(Continued)

FOREIGN PATENT DOCUMENTS

CN 101988598 A * 3/2011 ..... B65D 83/207
CN 101988598 B * 5/2012 ..... B65D 83/207
(Continued)

OTHER PUBLICATIONS

International Search Report filed in the corresponding PCT Application dated Aug. 17, 2021; 4 pages.
(Continued)

*Primary Examiner* — Bob Zadeh
(74) *Attorney, Agent, or Firm* — Rankin, Hill & Clark LLP

(57) ABSTRACT

A fluid storage system includes a container defining an interior space that lacks an internal valve. A product and a propellant are stored under pressure within the interior space. A container cap includes a membrane that encloses a space defined by a coupling element, which includes a releasable fastener that releasably couples a fluid dispensing apparatus to the container. The container cap also includes a dip tube comprising a proximate end that extends at least partially into the space defined by the coupling element, and a distal end that protrudes from the space in a direction generally away from the container cap, into the interior space defined by the container. The dip tube defines an interior passage extending between the proximate end and
(Continued)

the distal end through which the product is to be expelled from the container by the propellant.

14 Claims, 19 Drawing Sheets

(51) Int. Cl.
*B65D 83/32* (2006.01)
*B65D 83/38* (2006.01)
*B65D 83/70* (2006.01)

(56) References Cited

U.S. PATENT DOCUMENTS 2,802,696 A 8/1957 Franco
3,270,919 A * 9/1966 Frangos ..... B65D 83/382 222/394
3,589,446 A * 6/1971 Bower ..... A62C 13/76 222/82
4,228,933 A * 10/1980 Elson ..... B05B 9/0805 222/400.7
6,016,934 A * 1/2000 Moriguchi ..... B65D 83/42 222/402.18
9,656,310 B2 5/2017 Johnson
10,124,356 B2 * 11/2018 Johnson ..... B65D 83/207
10,926,277 B2 2/2021 Johnson
11,583,878 B2 2/2023 Johnson
2015/0273543 A1 * 10/2015 Johnson ..... B65D 83/207 141/4
2015/0314316 A1 * 11/2015 Kusz ..... B05B 15/30 222/105
2018/0244460 A1 8/2018 Zeik et al.
2019/0270576 A1 9/2019 Johnson et al.

FOREIGN PATENT DOCUMENTS

GB 855794 A * 12/1960
WO WO-9805853 A1 * 2/1998 ..... B01F 5/0451
WO WO-2006018593 A2 * 2/2006 ..... B65D 83/382
WO WO-2017130186 A1 * 8/2017 ..... B65D 83/0061
WO WO-2018090102 A1 * 5/2018

OTHER PUBLICATIONS

Written Opinion filed in the corresponding PCT Application dated Aug. 17, 2021; 7 pages.
International Preliminary Report on Patentability filed in the corresponding PCT Application dated Oct. 27, 2022; 8 pages.

* cited by examiner

FLUID DISPENSING METHOD AND APPARATUS

BACKGROUND OF THE INVENTION

1. Field of Invention

This invention generally relates to methods and apparatuses for dispensing paint or another product from pressurized containers and, more specifically, to a replaceable product dispensing apparatus to be used on more than one pressurized container and methods of manufacturing and using a replaceable product dispensing apparatus.

2. Description of Related Art

Traditionally, cans of spray paint are formed from a metallic canister defining an interior space with paint and a valve assembly sealed therein. A nozzle is exposed externally of the canister to be actuated by a user to discharge a mist of paint to apply a coating of paint onto a target surface. Since the valve assembly is sealed within the interior space defined by the canister, however, the valve is usable only with that one canister and is not removable. Also, any unused paint and propellant within the interior space require users to follow special disposal instructions, or require the user to manually discharge the unused contents through the nozzle by manually actuating the nozzle as is done during painting.

Such traditional cans of spray paint have also been manufactured by first sealing the valve within the canister and installing the nozzle on a valve stem that is exposed externally of the canister. Only then would the nozzle or valve stem be actuated to cause the valve to open the interior passage leading into the interior of the canister to allow the paint and propellant to be inserted into the canister through that open interior passage. Since the valve is already in place within the canister, once the canister is sufficiently filled the nozzle and/or valve stem could be released, thereby causing the valve to once again close the interior passage leading into the interior of the canister and trapping the paint and propellant therein. Filling the canister in this manner necessarily requires the valve to first be installed within the canister to close the interior passage and contain the contents once they have been inserted into the canister.

More recently, attempts have been made to position the valve assembly externally of the canister. When such a valve assembly is installed on the canister, a cap is punctured, thereby establishing fluid communication between the valve assembly and the interior of the canister. In use, the canister is inverted to cause the paint or other contents within the canister to be positioned adjacent to an inlet of the valve assembly under the force of gravity. Actuation of the valve assembly causes the paint pooled at the inlet of the valve assembly to be expelled by a propellant also contained within the canister. However, when the canister containing the paint is not inverted to cause the paint to pool at the inlet to the valve assembly actuation of the valve assembly fails to reliably cause paint to be expelled.

BRIEF SUMMARY OF THE INVENTION

Thus, there is a need in the art for a reusable aerosol dispensing apparatus including a valve assembly that can be removably installed on a plurality of different pressurized canisters, and a method of preparing an aerosol canister that lacks a dedicated valve assembly installed within the canister. Some embodiments of the present canister can include a container cap including a dip tube. The dip tube includes a proximate end that is adjacent to the container cap, optionally coupled to the container cap. The proximate end of the dip tube can be sealed prior to installation of the external valve assembly onto the canister. Installation of the external valve assembly onto the canister can puncture the seal, establishing fluid communication between the dip tube and the external valve assembly.

The dip tube extends generally away from the container cap, toward a floor of the canister while the canister is oriented upright, terminating at a distal end of the dip tube that is positioned adjacent to the floor. Paint or another product is dispensed from the canister through actuation of the external valve assembly. Although any liquid chemical composition or other material that can be dispensed as an aerosol is encompassed by the present disclosure, paint represents an illustrative example of such a product that is dispensed from the canister through actuation of the external valve assembly. For the sake of brevity and clarity, however, the substance that is to be dispensed from the canister according to the present disclosure will be generically referred to as a "product." As a result of the external valve assembly being actuated, the product is caused to enter the distal end of the dip tube by the propellant, and to pass through an interior passage of the dip tube toward the proximate end. Product passing through the dip tube exits the proximate end and enters an interior passage extending through the external valve assembly, which is selectively opened as a result of actuation of the external valve assembly. Product pooled at the floor of the canister while the canister is in an upright orientation (e.g., the container cap is positioned vertically above the floor of the canister) can thus be conveyed by the dip tube from the distal end, serving as an inlet aperture, to the proximate end at the container cap, serving as an outlet aperture.

According to some embodiments of this invention, a fluid dispensing apparatus may be used in dispensing a product fluid from an associated container under a pressure greater than ambient. The associated container may contain associated product and may have a pierceable membrane. The fluid dispensing apparatus may comprise: a valve body having a top, a bottom and a bore that extends through the valve body; an adaptor having a top, a bottom, a bore that extends through the adaptor and a piercing member; and, a nozzle attached to the top of the valve body and having a bore that is communicatable with the valve body bore. The bottom of the valve body may be attached to the top of the adaptor and the adaptor bore may communicate with the valve body bore. The fluid dispensing apparatus may be operable by attaching the bottom of the adaptor to the associated container to pierce the pierceable membrane with the piercing member to communicate the associated product within the container with the adaptor bore and thus with the valve body bore. The nozzle may be operable to permit the associated product within the associated container to flow under the pressure out of the associated container, through the adaptor bore, through the valve body bore and through the nozzle bore to ambient.

According to other embodiments of this invention, a method of dispensing a liquid product from an associated container under a pressure greater than ambient may be provided. The associated container may contain associated product and may have a pierceable membrane. The method may comprise the steps of: (A) providing a fluid dispensing apparatus comprising: (1) a valve body having a top, a bottom and a bore that extends through the valve body; (2)

an adaptor having a top attached to the bottom of the valve body, a bottom, a bore that extends through the adaptor and a piercing member; wherein the adaptor bore communicates with the valve body bore; and, (3) a nozzle attached to the top of the valve body and having a bore that is communicatable with the valve body bore; (B) attaching the bottom of the adaptor to the associated container to pierce the pierceable membrane with the piercing member to communicate the associated product within the container with the adaptor bore and thus with the valve body bore; and, (C) operating the nozzle to permit the associated product within the associated container to flow under the pressure out of the associated container, through the adaptor bore, through the valve body bore and through the nozzle bore to ambient.

According to still other embodiments of this invention, an apparatus may comprise: (A) a container containing a product fluid under a pressure greater than ambient and having a pierceable membrane; (B) a fluid dispensing apparatus comprising: (1) a valve body having a top, a bottom and a bore that extends through the valve body; (2) an adaptor having a top, a bottom, a bore that extends through the adaptor and a piercing member, wherein the bottom of the valve body is attached to the top of the adaptor and the adaptor bore communicates with the valve body bore; and, (3) a nozzle attached to the top of the valve body and having a bore that is communicatable with the valve body bore. The fluid dispensing apparatus may be operable by attaching the bottom of the adaptor to the container to pierce the pierceable membrane with the piercing member to communicate the product within the container with the adaptor bore and thus with the valve body bore. The nozzle may be operable to permit the product within the container to flow under the pressure out of the container, through the adaptor bore, through the valve body bore and through the nozzle bore to ambient.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

In the accompanying drawings, structures are illustrated that, together with the detailed description provided below, describe exemplary embodiments of the claimed invention. The invention may take physical form in certain parts and arrangement of parts, embodiments of which will be described in detail in this specification and illustrated in the accompanying drawings which form a part hereof and wherein:

DETAILED DESCRIPTION OF THE INVENTION

Figure 1:
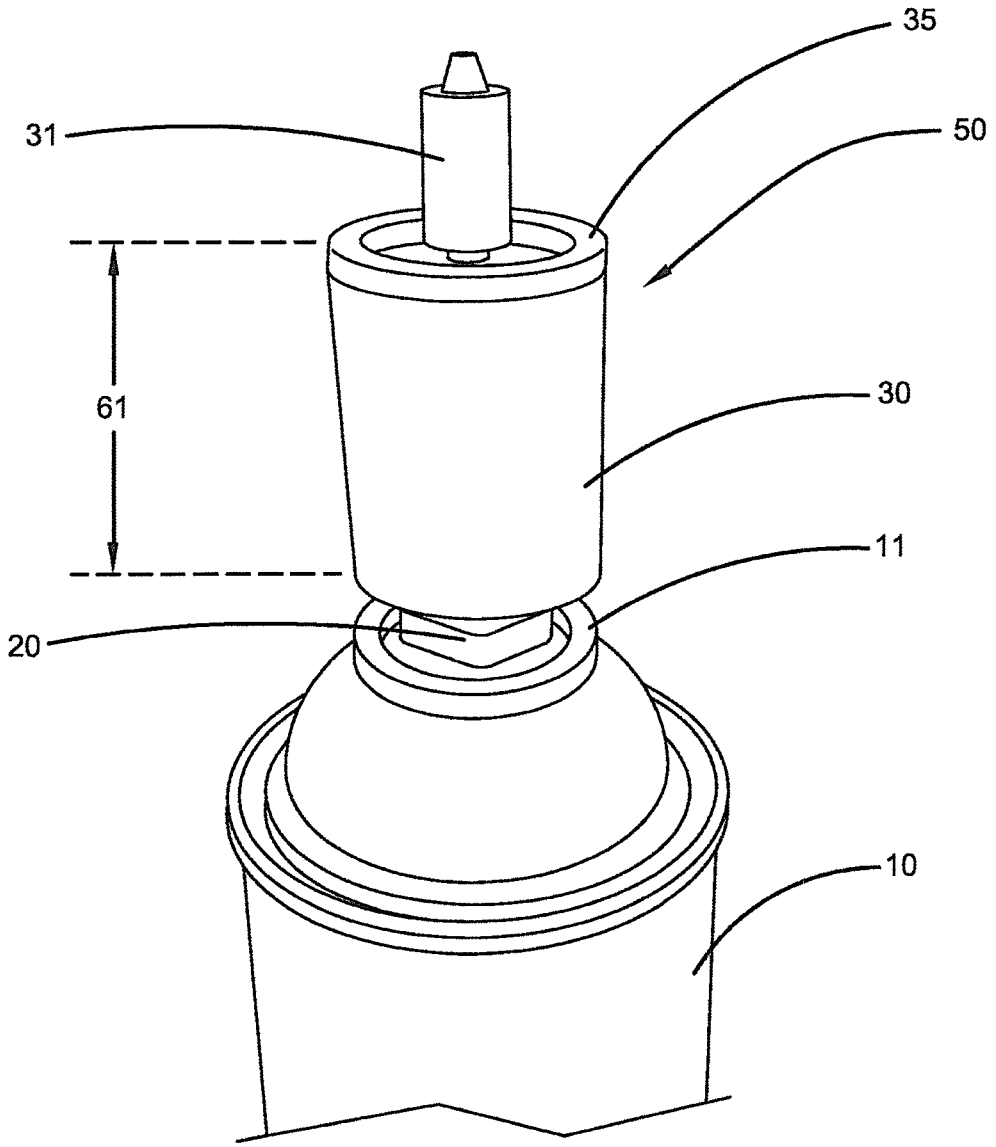
FIG. 1 is a perspective view of a fluid dispensing apparatus in accordance with some embodiments of this invention.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

Referring now to the drawings wherein the showings are for purposes of illustrating embodiments of the invention only and not for purposes of limiting the same, and wherein like reference numerals are understood to refer to like components, FIG. 1 shows a perspective view of a pressurized container 10 equipped with a fluid dispensing apparatus 50 equipped with an external valve body 30 according to some embodiments of this invention. The pressurized container 10 shown is a can made from one or more metals, metal alloys and/or one or more plastic materials, and is devoid of an internal valve within an interior space defined by the container 10 containing the product. In other words, the external valve body 30 is required to control and regulate the expulsion of the product under the pressure generated within the interior space of the container 10 by the propellant. Puncturing the membrane 15 as described below without the external valve body 30 would result in the uncontrolled release and depletion of the propellant from the container 10 to the ambient environment. However, the fluid dispensing apparatus 50 described herein will work with any type, size and shape of pressurized container 10. The product dispensed by the fluid dispensing apparatus 50 may be a pressurized chemical that is a liquid, gas, vapor, or a mixture thereof. While the fluid dispensing apparatus 50 is designed to dispense any product such as paint, it may have application to other chemicals as well.

With continuing reference to FIG. 1, the fluid dispensing apparatus 50 may, in some embodiments, include a nozzle 31, a valve body 30, and an adaptor 20. The nozzle 31 may be like nozzle 202 discussed above. Because the operation of such nozzles 31, 202—laterally displaceable to permit the contents to exit the nozzle and biased into a non-displaced position where the contents cannot exit the nozzle—are well known to people of skill in the art, no details will be provided here.

Figure 3:
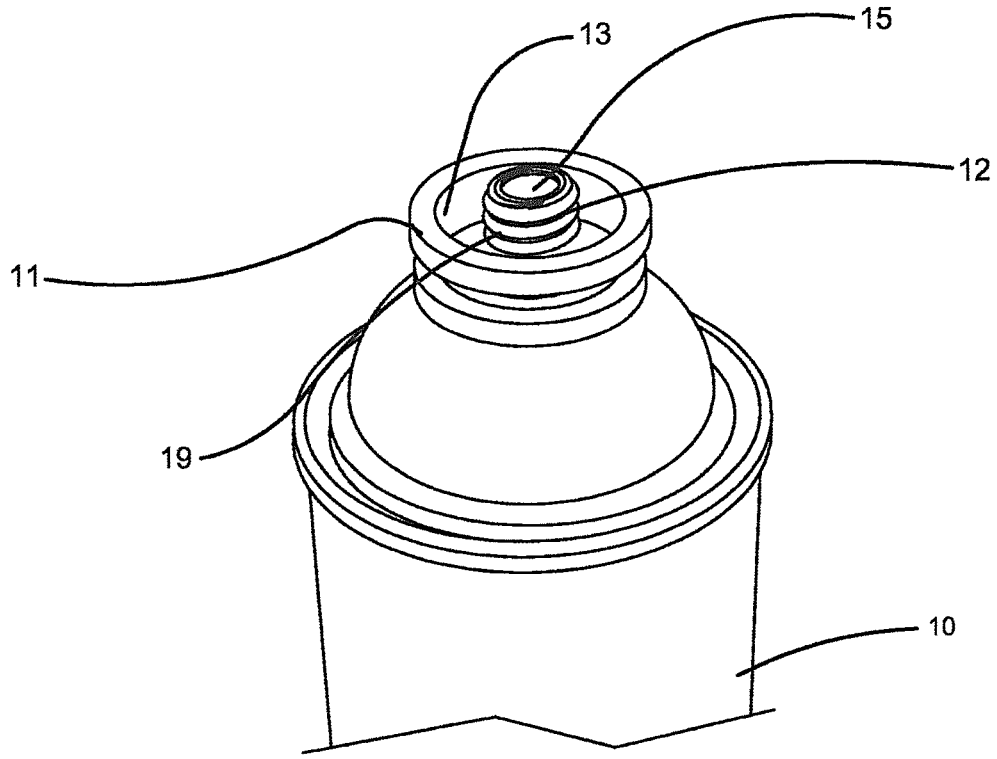
FIG. 3 is a perspective view of a container in accordance with some embodiments of this invention.
Figure 6:
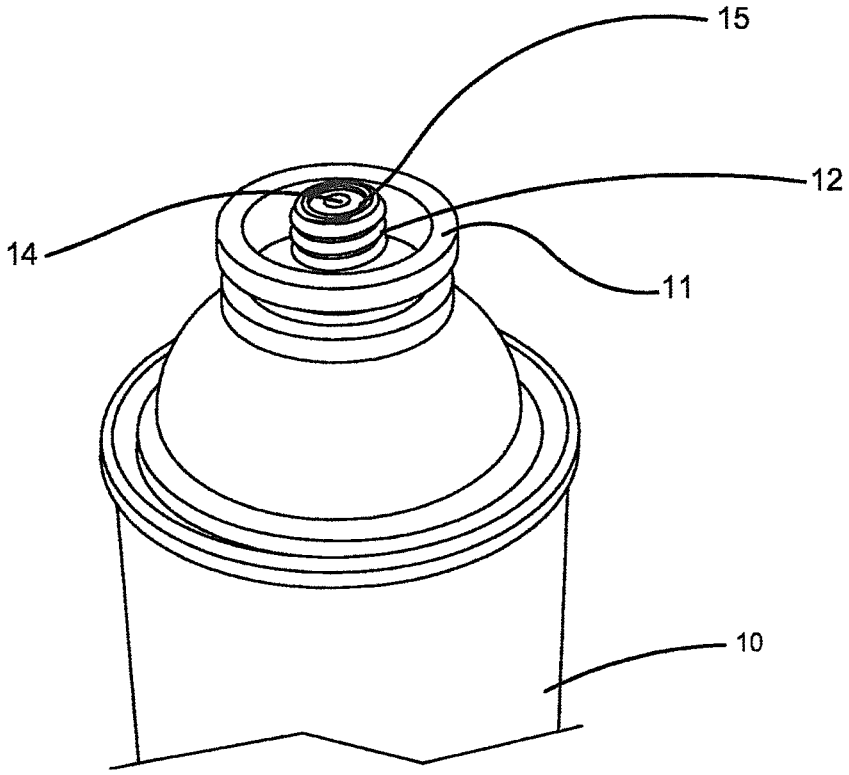
FIG. 6 shows a container in accordance with some embodiments of this invention with a pierceable membrane pierced.

With reference now to FIGS. 3 and 6, in order to use the fluid dispensing apparatus, it may be necessary to attach a container cap 11 to the pressurized container 10. The container cap 11 may, in one embodiment, be fixedly joined to the top of the pressurized container 10 such as being crimped in a known manner. The container cap 11 may be, in one embodiment, positioned substantially concentrically with the container's longitudinal axis. The container cap 11 may have a well 13, a coupling element 12, and a fluid passage bore 14 (visible in FIG. 6). A membrane 15 may cover the bore 14. Membrane 15 may be pierceable and located with respect to fluid passage bore 14 in such a manner as to seal bore 14 and prevent fluid from exiting container 10 until it is pierced. The embodiment of the membrane 15 shown in FIG. 3 includes a planar metal surface integrally formed as part of a monolithic structure along with the other portions of the container cap 11, such as the coupling element 12, well 13 and threaded section 19 described below, for example. Such structures can be integrally formed together by stamping a flat sheet of suitable metal stock into the desired shape of the container cap 11. FIG. 6 shows membrane 15 in a pierced or punctured condition which exposes fluid passage bore 14 to outside of the pressurized container 10, and establishes fluid communication with the fluid dispensing apparatus 50. In the illustrated embodiments, the membrane 15 is fixedly connected to the coupling element 12 to close an uppermost region of that coupling element 12. The coupling element 12 in FIGS. 3 and 6 is generally cylindrical, protruding upward from a base of the container cap 11 at the bottom of the well 13, but may be of any desired size, shape and relative position to the other portions of the container cap 11 to releasably couple the fluid dispensing apparatus 50 to the container cap 11. To be releasably coupled, the fluid dispensing apparatus 50 can be installed on, and subsequently removed from a plurality of containers 10 without being damaged to an extent that would prevent reuse of the fluid dispensing apparatus 50. In one embodiment coupling element 12 may have an externally threaded (male threading) section 19, as shown. For the embodiment shown, the coupling element 12 is cylindrical in shape and the threaded section 19 is on the exterior surface of the coupling element 12. The threading extends along a suitable length of the cylindrical coupling element 12 to urge the fluid dispensing apparatus 50 toward the container 10 a suitable distance to both: (i) compress an elastomeric gasket 23, interchangeably referred to herein as a seal 23 described below with reference to FIG. 4B, provided to the fluid dispensing apparatus 50 against a surface of the container cap 11, and (ii) form the seal that interferes with the escape of the propellant from the interior space of the container 10 between the container cap 11 and the fluid dispensing apparatus 50. Materials used to form container cap 11 can include any metal or metal alloy having dimensions that permit stamping a planar sheet of the metal or metal alloy into the desired shape of the container cap 11, although other materials are also considered to be within the scope of the present disclosure.

Figure 13:
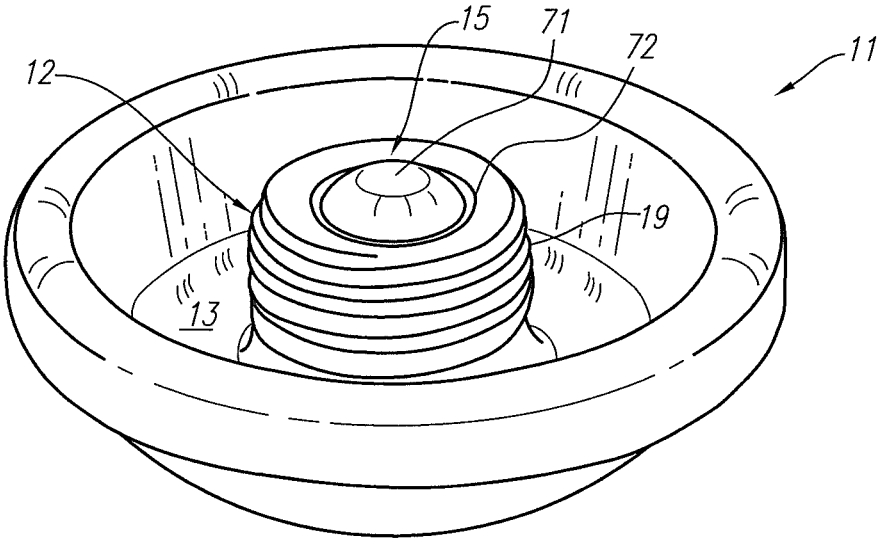
FIG. 13 is a top perspective view of an embodiment of a container cap.
Figure 14:
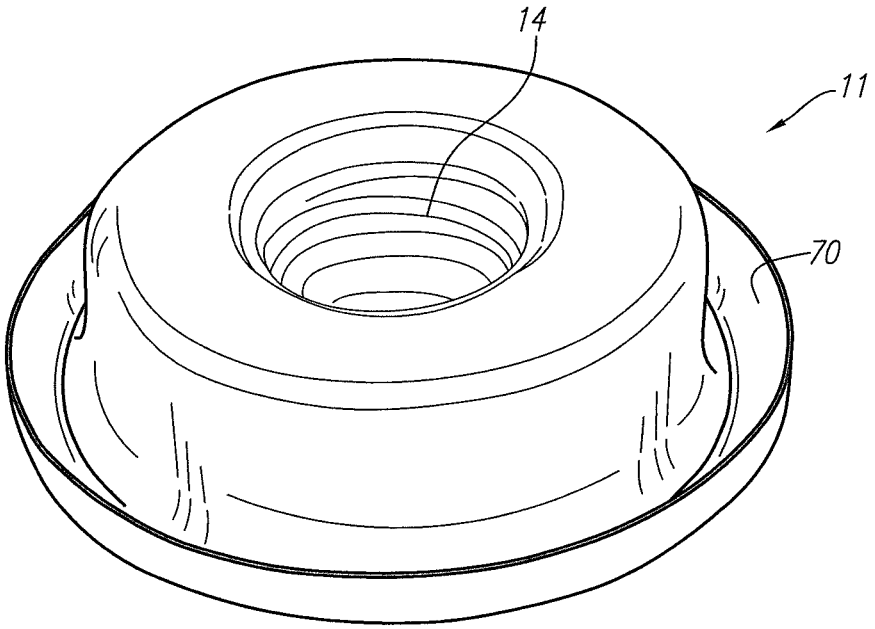
FIG. 14 is a bottom perspective view of the embodiment of the container cap shown in FIG. 13.

An alternate embodiment of the container cap 11 is shown in FIGS. 13 and 14. Like the previous embodiment, the present embodiment of the container cap 11 includes a cylindrical coupling element 12 with a threaded section 19 and a well 13 disposed between the coupling element 12 and a collar defining a downward-opening, annular channel 70 (FIG. 14) that extends about an external periphery of the container cap 11. However, the membrane 15 of the embodiment shown in FIG. 13 includes an elevated region 71 or plateau that protrudes upward from a neighboring or surrounding region 72 of the membrane 15. The coupling element 12 of any of the embodiments can also include a sealing surface 74 against which the gasket 23, described below, can be compressed against to interfere with the leakage of propellant between the fluid delivery apparatus 50 and the coupling element 12 of the container cap 11.

With reference now to FIGS. 1, 4A, 4B and 6, embodiments of adaptor 20 will now be described. Adaptor 20 may be, in some embodiments, a generally cylindrically shaped component with a top and an opposing bottom. Referring to FIG. 4B, located on the bottom of adaptor 20 may be a coupling element 21. Coupling element 21 may engage with coupling element 12 of container cap 11. In one specific embodiment, shown, coupling element 21 may be formed on an inner cylindrical shaped portion of adaptor 20 and may have a threaded section 57. The adaptor 20 may have a fluid passage bore 26 that may extend from the top to the bottom of the adaptor 20. The adaptor 20 may also have a piercing member 27 used to pierce membrane 15 (shown unpierced in FIG. 3 and pierced in FIG. 6). The piercing member 27, in some embodiments, may be located concentric to the longitudinal axis of fluid passage bore 26 and may extend beyond bottom surface of fluid passage bore 26. The piercing member 27 may be positioned at least partially within the adaptor bore 26. On the end of piercing member 27 that extends beyond the bottom surface of bore 26, a tip may be formed and configured to pierce membrane 15. The adaptor 20 may also have a seal or gasket 23 that interferes with, and optionally prevents the escape of propellant and/or product except through the bore 26. The gasket 23 may be formed of an elastomeric material.

Figure 18:
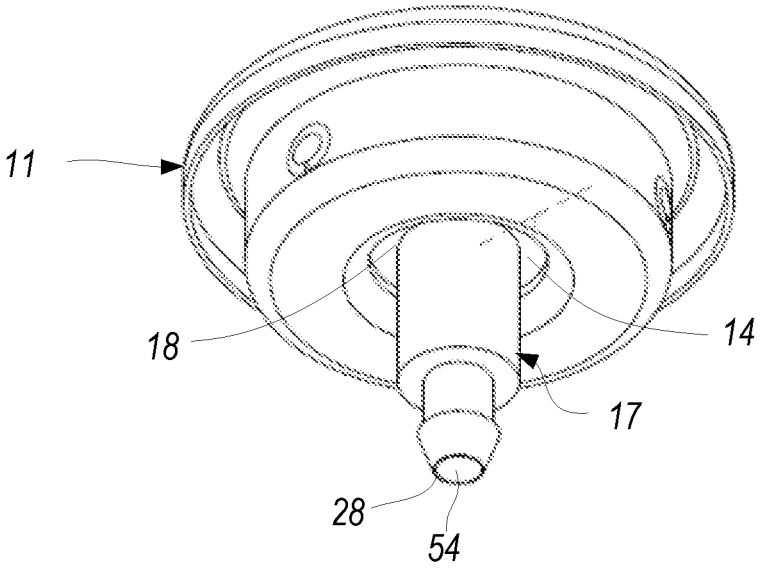
FIG. 18 is a bottom, perspective view of the illustrative embodiment of the container cap appearing in FIG. 17.

Alternate embodiments of the container cap 11 are shown in FIGS. 17-20. Similar to preceding embodiments, the container cap 11 in FIG. 17 includes the coupling element 12 defining the bore 14 (FIG. 18). External threading 19 can be provided to an external periphery of the coupling element 12 for cooperating with the compatible threaded section 57 provided to the fluid dispensing apparatus 50 to releasably couple the fluid dispensing apparatus 50 to the container 10, as described herein. The membrane 15 to be punctured is provided adjacent to a distal end of the coupling element 12 that protrudes generally away from the container 10 while the container cap 11 is installed on the container 10.

Figure 20:
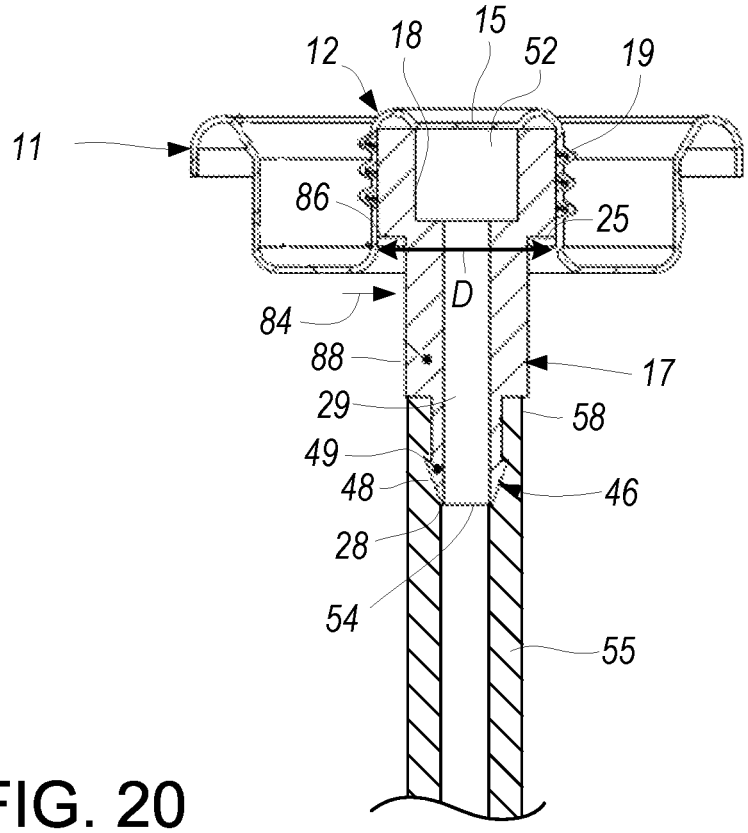
FIG. 20 is a sectional view taken along line 20-20 in FIG. 19, with an extension tube installed.

As shown in FIGS. 18 and 20, a proximate end 18 of a dip tube 17 extends into the bore 14 defined by the coupling element 12. A distal end 28 of the dip tube 17 is supported at an elevation vertically beneath an elevation of the proximate end 18, while the container cap 11 is installed on a container 10 in an upright orientation. In the upright orientation, a floor of the container 10, forming a bottom surface on which the container 10 rests in the upright orientation, supports the liquid product within the container 10 under the force of gravity. In other words, the container cap 11 is positioned at an elevation vertically above an elevation of the floor of the container 10 while the container 10 is in the upright orientation, and the product within the container 10 is caused to pool on the floor by the force of gravity.

According to some embodiments, the container cap 11 and the dip tube 17 can be formed as part of a common, monolithic structure. According to such embodiments, the dip tube 17 can be formed from a metal, metal alloy, or any other material used to form the container cap 11. According to other embodiments, the dip tube 17 can be formed as a separate structure, distinct from the container cap 11. For example, the dip tube 17 can be formed from a polymeric material, and a proximate end 18 of the dip tube 17 coupled to a portion of the container cap 11.

Figure 21:
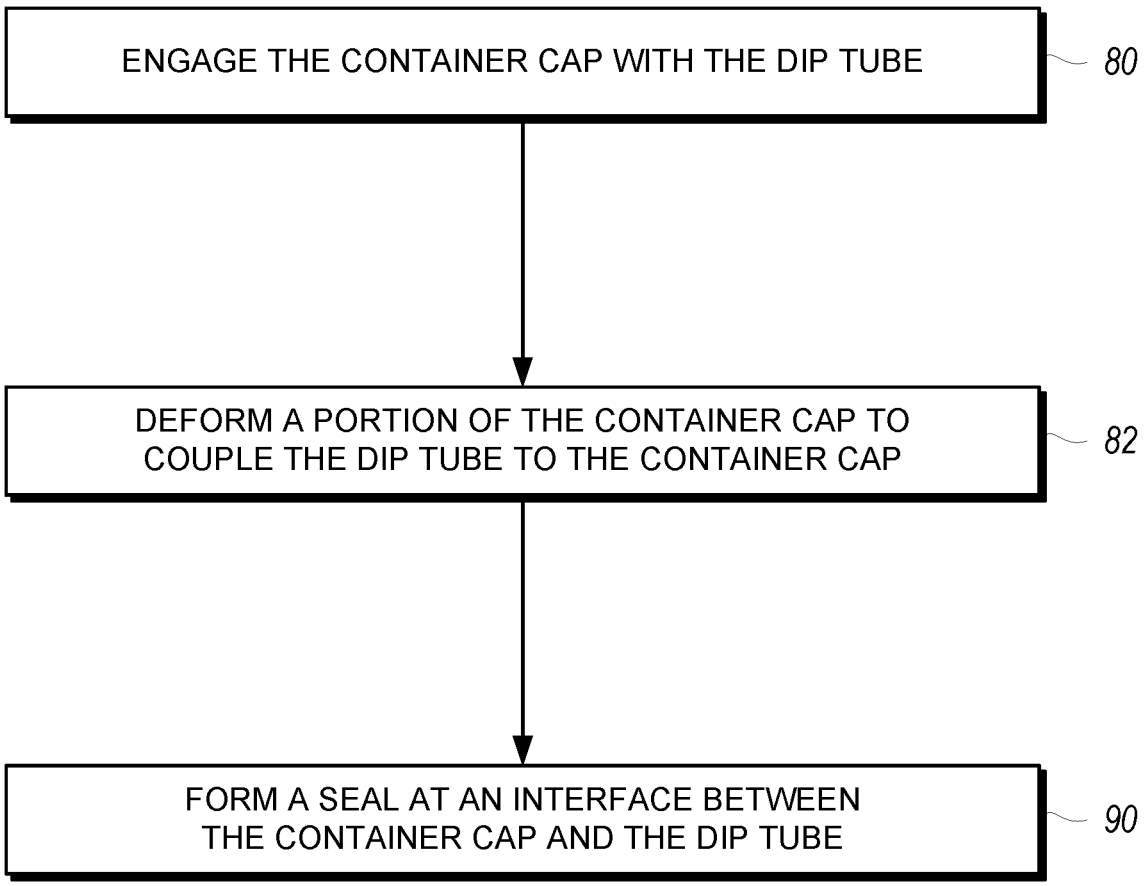
FIG. 21 is a flow diagram graphically representing a process of forming a container cap, according to some embodiments.

FIG. 21 represents an illustrative embodiment of a process of forming the container cap 11 including a separate structure. A portion of the dip tube 17 can engage a portion of the container cap 11 at block 80. For example, at least a portion of the proximate end 18 of the dip tube 17 can be received within the space 52 defined by an internal periphery of the coupling element 12, as shown in FIG. 20. As described in detail elsewhere herein, the coupling element 12 can include a releasable fastener such as the threading 19, that engages the compatible threaded section 57 of the fluid dispensing apparatus 50, to couple the fluid dispensing apparatus 50 to the container cap 11.

With the proximate end 18 of the dip tube 17 at least partially received within the interior space 52, a portion of the container cap 10 can be deformed at block 82 to interfere with removal of the proximate end 18 of the dip tube 17 from the interior space 52. For example, the container cap 11 can be stamped from a sheet of a metallic material. The proximate portion 18 of the dip tube 17 can be at least partially inserted into the space 52 defined by the interior periphery of the coupling element 12, and a portion of the container cap 11, such as a base 25 (FIG. 20) of the coupling element 12 adjacent to the well 13 for example, can be crimped against or about a portion of the proximate end 18 of the dip tube 17, or otherwise deformed to secure the proximate end 18 of the dip tube 17 within the space 52.

Crimping can deform the base 25 in a radially-inward direction indicated generally by arrow 84 (FIG. 20). As a result, the dimension D (FIG. 20) of the interior space 52 is suitable to allow insertion of a portion of the proximate end 18 of the dip tube 17 into the interior space 25 before crimping. According to some embodiments, the proximate end 18 of the dip tube 17 can optionally include a flange 86 that extends radially outward from another region 88 of the dip tube 17. The dimension D is smaller after crimping than it was before crimping as a result of the deformed portion of the container cap 11 projecting radially inward in the direction indicated by arrow 84, thereby interfering with removal of the proximate end 18 of the dip tube 17 from the interior space 52.

Crimping the portion of the container cap 11 about the portion of the dip tube 17 can optionally form a seal at block 90 (FIG. 21), at an interface between the dip tube 17 and the container cap 11. The seal can be substantially hermetic, or at least be suitable to interfere with the escape of the paint or other aerosol product from the container 10, and provide the container 10 with a shelf life of at least six months, or at least a year, etc. According to some embodiments, a gasket, adhesive, or other sealant can optionally be used to fortify the seal between the container cap 11 and the dip tube 17. A distal end 54 of the dip tube 17 protrudes outwardly from an underside of the container cap 11, to be positioned at least partially within the container 10 with the container cap 11 coupled to the container 10.

The dip tube 17 defines an interior passage 29 (FIG. 20) extending between the proximate end 18 and the distal end 28. The dip tube 17 can be formed from any suitable metallic, polymeric or other plastic material with rigidity sufficient to maintain a shape of the dip tube 17 when the container 10 is angularly displaced from the upright orientation. Thus, the distal end 28 remains closer to the floor of the container 10 than the proximate end 18 of the dip tube 17 when the container 10 on which the container cap 11 is installed is angularly adjusted away from the upright orientation.

Figure 19:
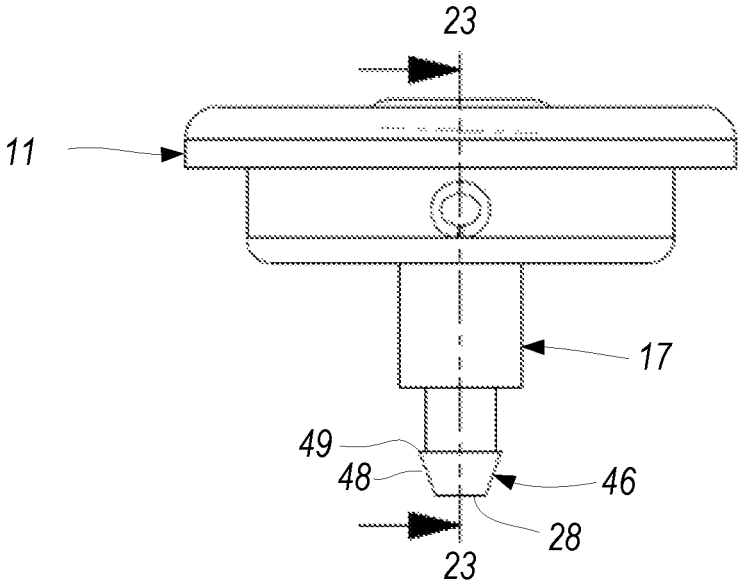
FIG. 19 is a side view of the illustrative embodiment of the container cap appearing in FIG. 18.

Some embodiments of the dip tube 17 have an external barb 46, as shown in FIGS. 19 and 20. The barb 46 can be formed in an inverted frustoconical shape, including a tapered region 48 extending between the distal end 28 and a flange 49. The barb 46 can engage an extension tube 55 (FIG. 20) by allowing a first end 58 of the extension tube 55 to be slid along or otherwise placed over the tapered region 48 of the barb 46, in a direction generally toward the proximate end 18 of the dip tube 17. Once the first end 58 of the extension tube 55 reaches the flange 49, a portion of the extension tube 55 extends in a radial inward direction, generally toward the interior passage 29, to engage the flange 49. Engagement of the flange 49 by the portion of the extension tube 55 interferes with movement of the first end 58 of the extension tube 55 away from the proximate end 18 of the dip tube 17, thereby interfering with removal of the extension tube 55 from the dip tube 17.

Alternate embodiments of the dip tube 17 can optionally extend a distance from the container cap 11 toward the floor of the container 10, to position a portion of the distal end 28 of the dip tube 17 adjacent to the floor of the container 17 (e.g., within a quarter (¼ in.) of an inch, within a third ($\frac{1}{3}^{rd}$ in.) of an inch, or in contact with the floor), in the absence of the extension tube 55 as a separate structure. For example, the dip tube 17 can optionally include the extension tube 55 formed as part of a common monolithic structure that extends substantially the entire distance between the container cap 11 and the floor of the container 10, eliminating the need for the assembly of separate parts, and simplifying the manufacture of the present container 10, for use with the present fluid dispensing apparatus 50. For the embodiments where the distal end 28 of the dip tube 17 or the second end of the extension tube 55 is positioned adjacent to the floor of the container 10, the fluid dispensing apparatus 50 is operable to control the discharge of the paint or other aerosol product from the container 10 lacking an internal valve, while the container 10 is in the upright orientation.

As shown in FIG. 20, the proximate end 18 of the dip tube 17 can be sealed by the membrane 15, to interfere with expulsion of the product through the dip tube 17 while the membrane 15 is intact. For example, prior to installation of the fluid dispensing apparatus 50 to puncture the membrane 15 as described herein, the membrane 15 encloses a space 52 (FIG. 20) defined, at least in part, by portions of the coupling element 12, including the membrane 15. While the membrane 15 is intact, the pressure within the space 52 is suitable to interfere with the uncontrolled expulsion of the product from the container 10 through the dip tube 17 by the propellant. Thus, the dip tube 17 can include an open, unobstructed interior passage 29 through which the product would be expelled from the container 10 by the propellant in the absence of the membrane 15 or other plug member. The container 10, including the container cap 11 with the dip tube 17 installed on the container 10, can optionally be devoid of a valve within the interior space defined by the container 10 that selectively controls the release of the product through the dip tube 17.

Upon installation of the fluid dispensing apparatus 50 as described herein, the membrane 15 can be pierced by the piercing member 27, for example, thereby establishing fluid communication between the fluid dispensing apparatus 50 and the space 52, and accordingly the interior space of the container 10 through the dip tube 17. For example, the piercing member 27 can define an interior passage and extend into the space 52, allowing paint introduced into the space 52 to be urged through the piercing member 27 as described elsewhere herein. A nozzle 31 of the fluid dispensing apparatus 50 can be laterally displaced, pushed downward, in a direction generally toward the container 10, or otherwise manipulated to selectively open the valve provided to the fluid dispensing apparatus 50. Such manipulation of the nozzle 31 causes the valve body bore defined by the fluid dispensing apparatus 50 to be opened. The propellant operates to cause the product to be introduced to the interior passage 29 of the dip tube 17 at an elevation adjacent to the floor of the container 10 through an aperture 54 (FIG. 18) formed at the distal end 28. The product so introduced is urged through the interior passage 29 of the dip tube 17, and expelled from the dip tube 17 through an aperture formed at the proximate end 18 of the dip tube 17. The product is urged through the valve body bore of the fluid dispensing apparatus 50, and through the nozzle 31.

Although the expulsion of paint is an example of a product that can be dispensed via the present apparatus and method, the present disclosure is not so limited. Any chemical or other substance in the form of a liquid, gas or other fluid can be dispensed as an aerosol or in any other form as described herein. For example, the fluid dispensed can be a cosmetic product such as hairspray, an aromatic substance such as aftershave, a food product such as cooking oil, and any other substance that can be dispensed as an aerosol.

Regardless of the form of the container cap 11, the threading provided to the threaded section 57 of the adaptor 20 engages compatible threading provided to the container (e.g., threading 19 provided to the coupling element 12 of the container cap 11) to couple the fluid dispensing apparatus 50 to the container 10. As the adaptor 20, and accordingly the various embodiments of the valve body 30, 30', 30" described herein, are brought together during installation through cooperation between the respective threaded sections, the piercing member 27 is caused to puncture the membrane 15 substantially simultaneously with compression of the gasket 23 against the sealing surface 74 of the coupling element 12. Premature contact between the gasket 23 and the sealing surface 74 may interfere with sufficient insertion of the piercing member 27 to puncture the membrane 15. However, recessing the gasket 23 too far into the adaptor 20 may prevent the gasket from reaching the sealing surface 74 of the coupling element 12, thereby allowing propellant to leak between the fluid dispensing apparatus 50 and the container cap 11. Thus, the arrangement of the gasket 23, piercing member 27 and the threaded section 57 of the adaptor 20 can be arranged to cause the gasket 23 to contact the sealing surface 74 approximately simultaneously (e.g., within one rotation of the adaptor 20 relative to the coupling member 12, or within three-quarters, half or one quarter rotation of the adaptor 20 relative to the coupling member 12, etc.) with the puncture of the membrane 15 by the piercing member 27. Engagement between the threading provided to the adaptor 20 and the coupling member 12 can define a range of travel of the fluid dispensing apparatus 50 relative to the container 10 during installation. The piercing member 27 can be arranged to puncture the membrane 15 and the gasket can be arranged to be compressed against a portion of the container cap 11 along that range of travel.

Figure 4A:
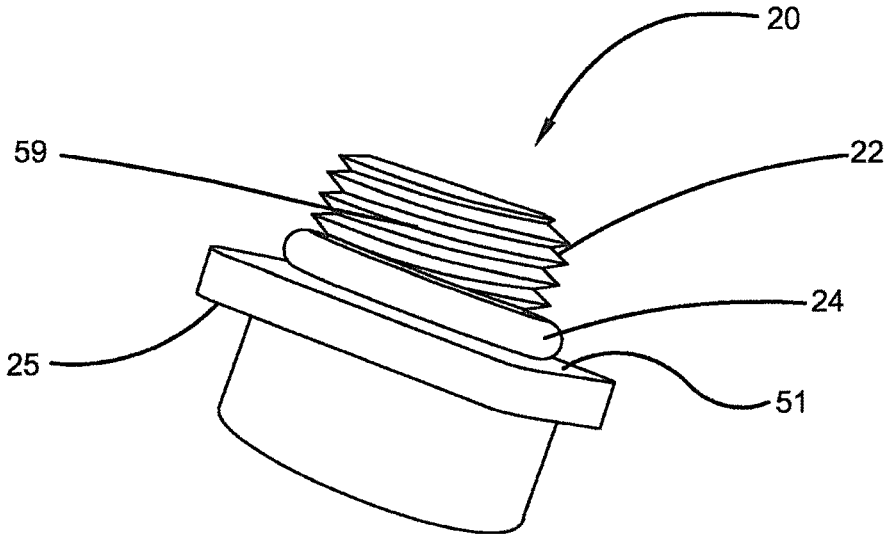
FIG. 4A is a perspective side view of an adaptor in accordance with some embodiments of this invention.
Figure 4B:
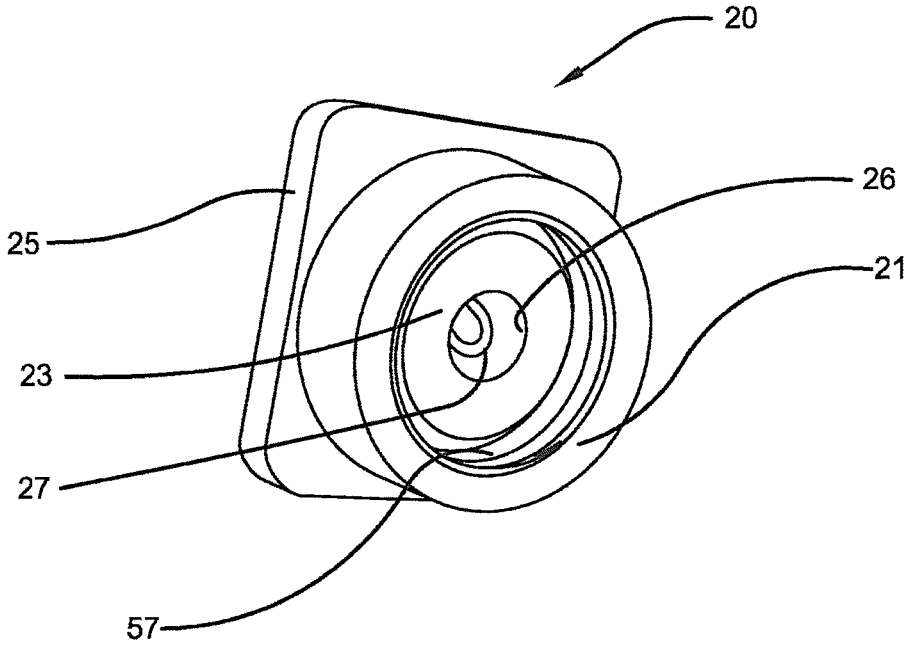
FIG. 4B is a perspective bottom view of an adaptor in accordance with some embodiments of this invention.

With reference now to FIG. 4A, located on the top of the adaptor 20 may be a coupling element 22. In one specific embodiment, shown, coupling element 22 may be formed on an outer cylindrical shaped portion of adaptor 20 and may have a threaded section 59. The coupling element 22 may be used to engage with a coupling element of the valve body 30, as will be discussed further below. A seal 24 may be used to seal the connection between the top of the adaptor 20 and the bottom of the valve body 30. For the embodiment shown, the seal 24 is an O-ring received around the cylindrically shaped portion of the adaptor 20 that has the coupling element 22. The seal 24 may be formed of an elastomeric material. The adaptor 20 may have a shoulder 25 extending outwardly, as shown. The top of the shoulder 25 may have a surface 51 that acts as a stop that contacts a surface of the valve body 30 when the adaptor 20 and valve body 30 are attached together. The adaptor 20 may be formed of any material(s) chosen with the sound judgment of a person of skill in the art. In one embodiment, the adaptor 20 is formed of copper.

Figure 5:
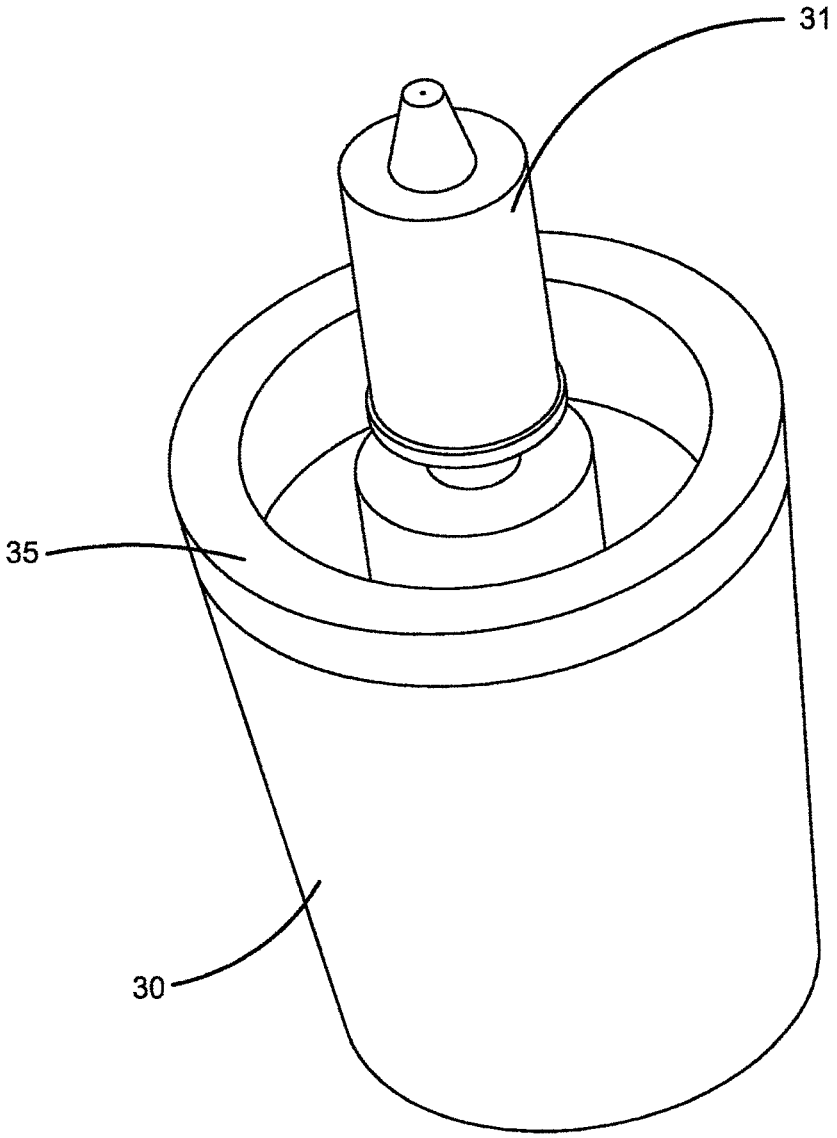
FIG. 5 is a perspective view of a dispensing apparatus in accordance with some embodiments of this invention.
Figure 7:
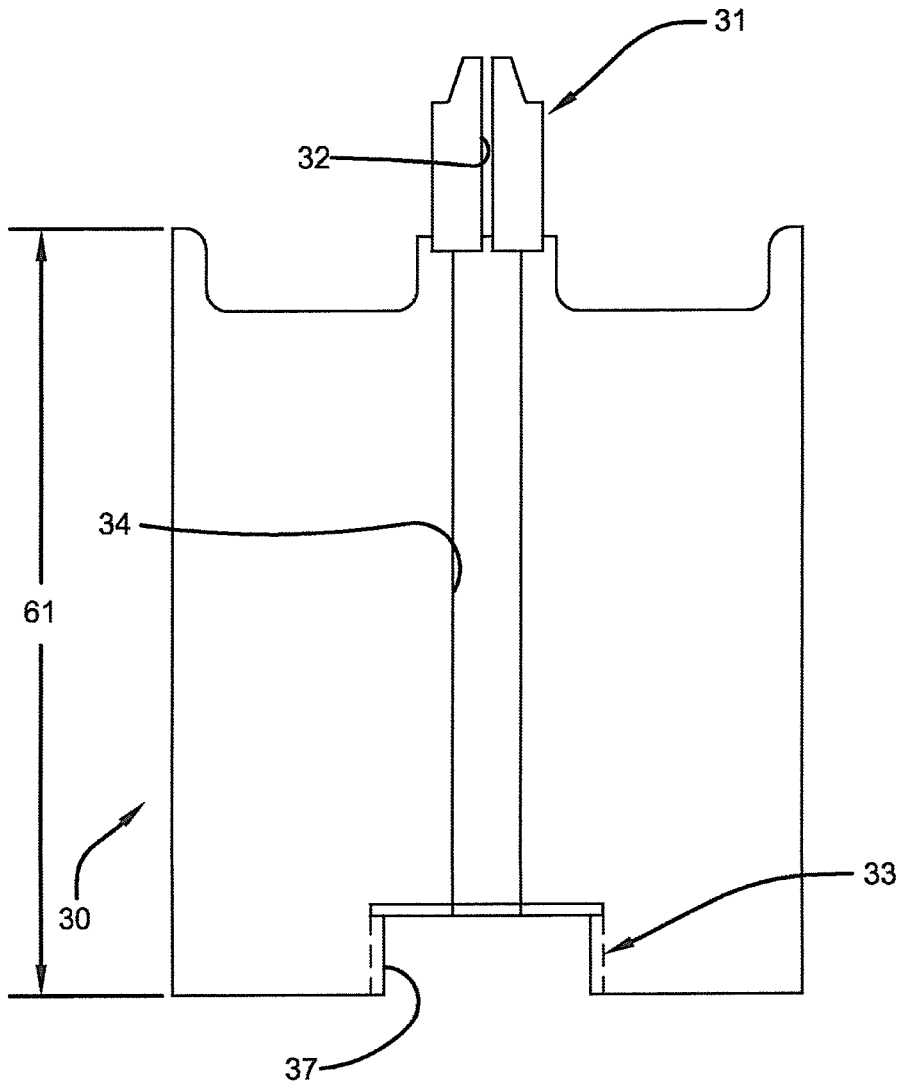
FIG. 7 shows a sectional view of a valve body in accordance with some embodiments of this invention.

With reference now to FIGS. 1, 5 and 7, embodiments of the valve body 30 will now be described. The valve body 30 may have a valve cap 35 on its top, as shown. The valve cap 35 may have any design suitable to properly receive the nozzle 31 as chosen by a person of skill in the art. In one embodiment, shown, the valve cap 35 is similar in design to the top of the can 200, just below the nozzle 202, shown in FIG. 2. The valve body 30 may be substantially cylindrical in shape and may have a height 61. The height 61 may range between 1.0 to 4.0 inches. Valve body 30 may have a fluid passage bore 34, as shown in FIG. 7. The bore 34 may extend from bottom to the top of the valve body 30, as shown. In one embodiment, the bore 34 may be centered along the valve body's longitudinal axis. A coupling element 33 may be located on a bottom surface, as shown. In one specific embodiment, shown, coupling element 33 may be formed on an inner cylindrical shaped portion of valve body 30 and may have a threaded section 37. The coupling element 33 may be used to engage with coupling element 22 of the adaptor 20. In one specific embodiment, threaded section 37 engages threaded section 59 to attach the valve body 30 to the adaptor 20. The valve body 30 may be formed of any material chosen with the sound judgment of a person of skill in the art.

Figure 2:
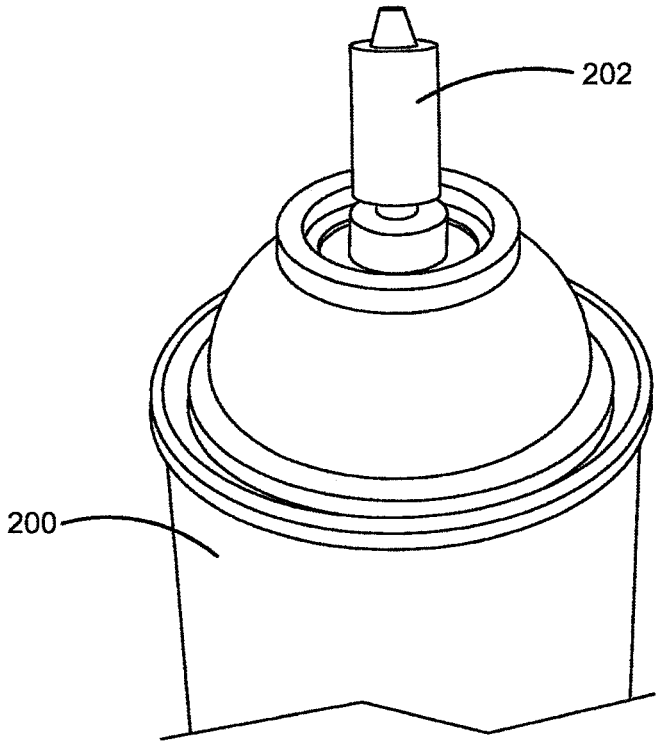
FIG. 2 PRIOR ART
FIG. 2 is a perspective top view showing a prior art paint can and nozzle.

With reference now to FIGS. 1, 5 and 7, the nozzle 31, which may have a fluid passage bore 32, may be joined to the valve cap 35 in a known manner—similar to how the nozzle 202 is joined to can 200 in FIG. 2. Nozzle 31 may dispense product out of the valve body 30 to the ambient when the nozzle 31 is operated in a known manner (similar to nozzle 202 in FIG. 2). Specifically, nozzle 31 may be configured such that it can be selectively deflected from its longitudinal axis and when so deflected its bore 32 is in fluid communication with central bore 34. Nozzle 31 may be configured such that it is capable of being deflected by manually generated forces. Nozzle 31 may also be configured with a biased position such that when no force is applied, nozzle 31 returns to a position that prevents fluid communication with central bore 34.

Figure 8:
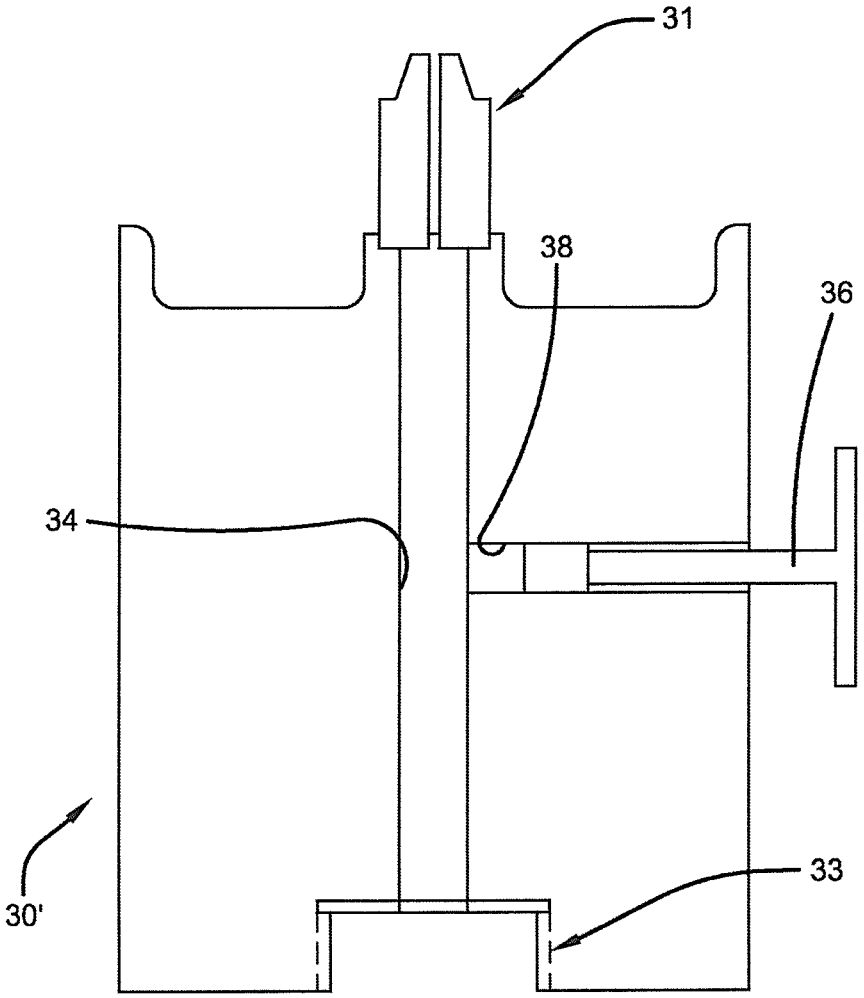
FIG. 8 shows a sectional view of a valve body with pressure relief valve in accordance with some embodiments of this invention.

FIG. 8 illustrates another embodiment valve body 30'. Valve body 30' is similar to valve body 30 described above except that it may include a pressure relief valve 36. In this embodiment valve body 30' may include a transverse fluid passage bore 38. Bore 38 may communicate on one end with bore 34 and on the opposing end with the area outside of the confines of valve body 30'. Located in bore 38 may be pressure relief valve 36. Pressure relief valve 36 may be chosen to operate in a plurality of modes. One mode may be such that in an initial condition relief valve 36 substantially seals bore 38 from the area outside. A second mode may be, once the user depresses relief valve 36, transverse bore 38 connects central bore 34 with the area outside of the confines of valve body 30'. Operating in this second mode, when attached to valve body 30', the pressure inside container 10 is minimized or released to the ambient without the fluid also being dispensed to the ambient. A third mode is the relief valve 36 opens automatically when pressure inside the container 10 exceeds a predetermined value. When this occurs, the pressure inside container 10 is minimized or released to ambient. Materials used in forming pressure relief valve 36 may be chosen with the sound judgment of a person of skill in the art. The operation modes of pressure relief valve 36 may also be chosen with the sound judgment of a person of skill in the art.

Figure 11:
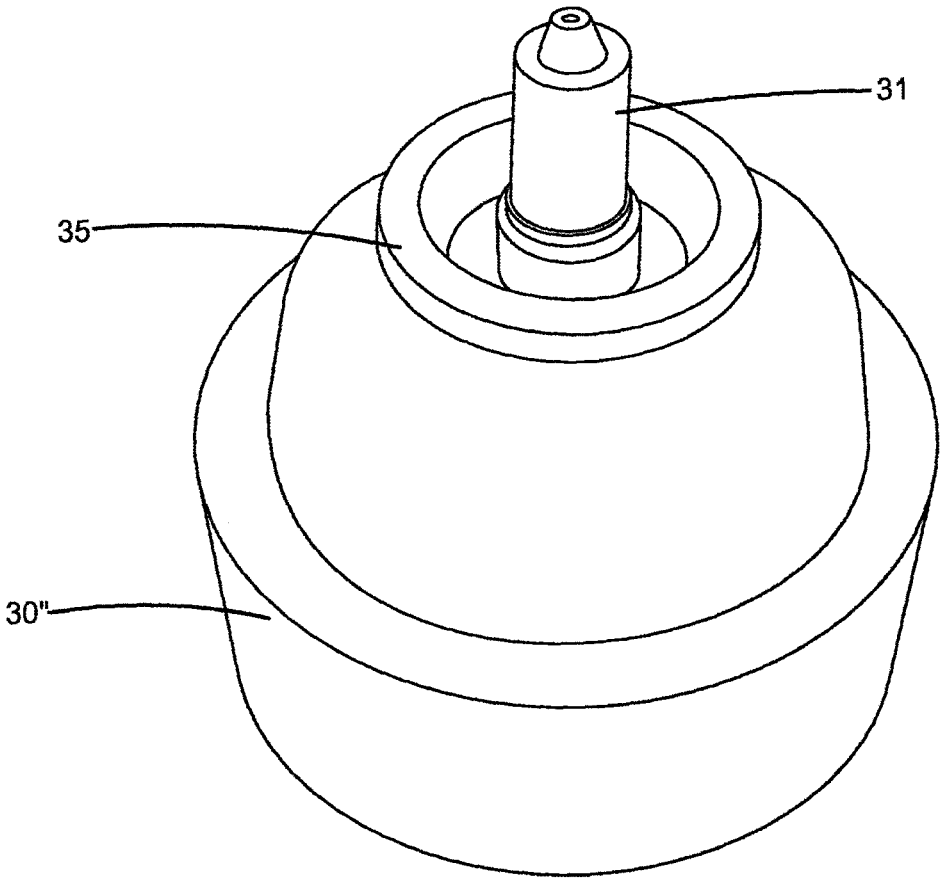
FIG. 11 is a top perspective view of a valve body according to some embodiments of this invention.
Figure 12:
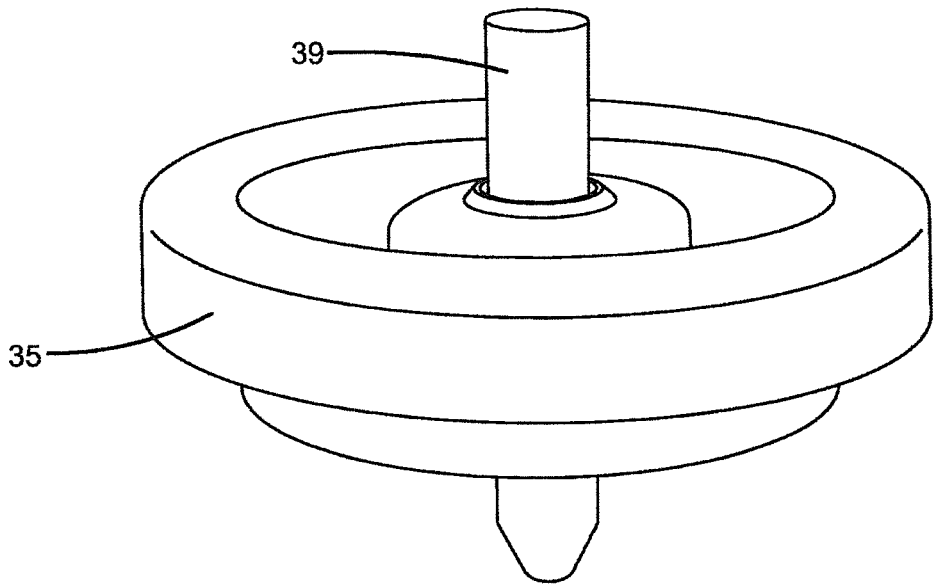
FIG. 12 is a side perspective view of a valve cap according to some embodiments of this invention.

With reference now to FIG. 11, another embodiment valve body 30" is shown. Valve body 30" has a valve cap 35 and attaches to a nozzle 31 as with previously described valve bodies 30 and 30'. Valve body 30", however, is designed to resemble the size and shape of the container 10. Compare FIG. 11 with FIG. 2. FIG. 12 shows stem 39 which extends through the valve cap 35 and is used to operate nozzle 31 in a known manner.

Figure 15:
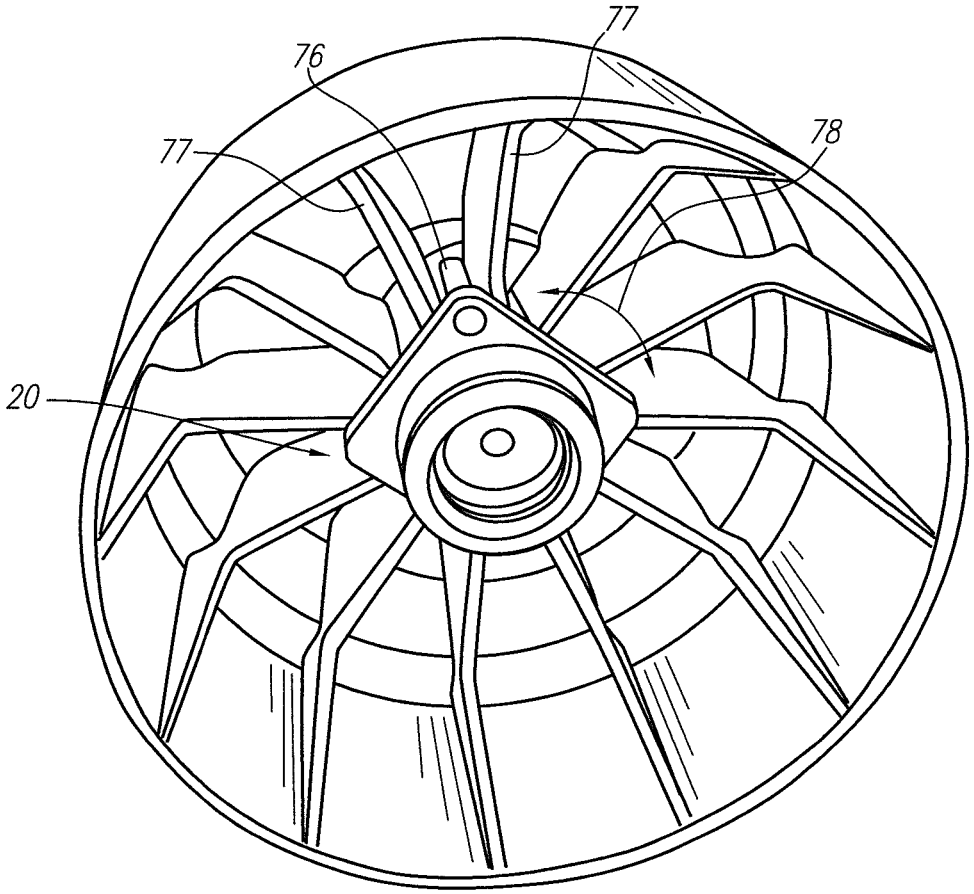
FIG. 15 is a bottom perspective view of the valve body shown in FIG. 11.

A bottom view of the valve body 30" is shown in FIG. 15. The adaptor 20 such as that described above is coupled to the underside of the valve body 30" in fluid communication with a valve mechanism housed by the valve body 30". For embodiments where the adaptor 20 is not integrally formed with the valve body 30 and/or valve mechanism, rotating the valve body 30" in a counterclockwise direction about the longitudinal axis of the container 10 to remove the valve body 30" imparts a force that could cause counterclockwise rotation of the adaptor 20 relative to the valve body 30". Such relative rotation could result in separation of the adaptor 20 from the valve body 30". To interfere with such separation, one or more locking structures 76 such as a post can optionally extend through the shoulder 25 of the adaptor 20 and into the underside (between two reinforcing gussets 77 in FIG. 15) of the valve body 30" to prevent rotation of the adaptor 20 relative to the valve body 30" in the directions indicated by arrows 78, during installation and removal of the fluid dispensing apparatus 50.

Figure 9:
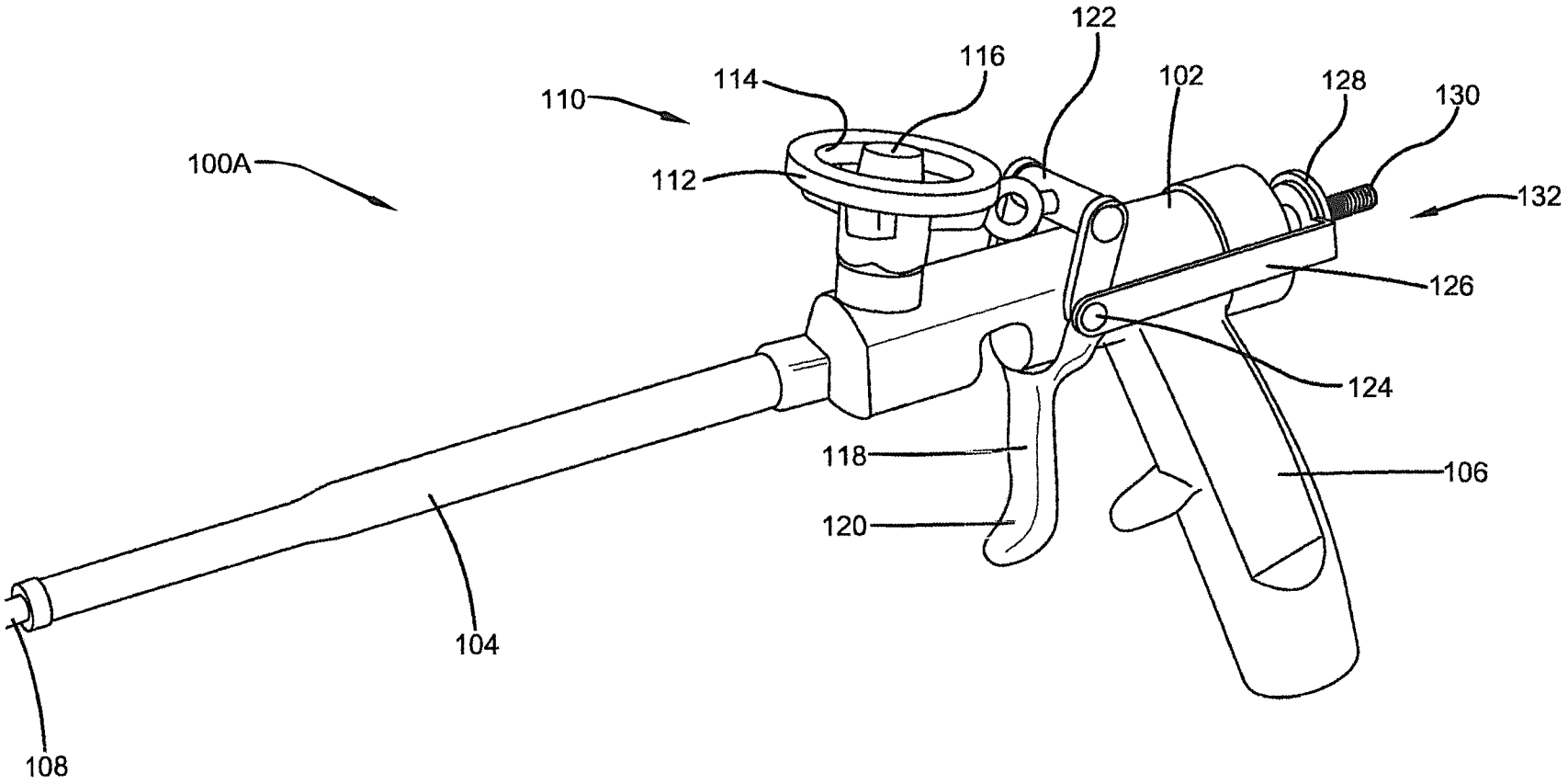
FIG. 9 is a side perspective view of a spray apparatus according to some embodiments of this invention.

With reference now to FIGS. 1, 2, 9 and 10, spray apparatuses 100A, 100B are shown. Because many of the components are similar, many of the same reference numbers will be used in both. Each spray apparatus 100A, 100B may include a housing 102, a barrel 104 supported to the housing 102 and a handle 106 also supported to the housing 102. For the embodiments shown, the spray apparatuses 100A, 100B may have a pistol-shape but other shapes may work well also. The barrel 104 may be hollow and may extend distally (away from the handle) to a tip 108. The hollow barrel 104 and tip 108 may define a fluid passageway bore. In one embodiment, the tip 108 is the distal end of the apparatus 100A, 100B and the point from which product fluid is dispensed. In another embodiment, the tip 108 comprises a fitting to which another component (not shown) may be attached and from which the product fluid is dispensed. The barrel 104 may decrease in outside diameter, as shown in FIG. 9, in the distal direction.

Figure 10:
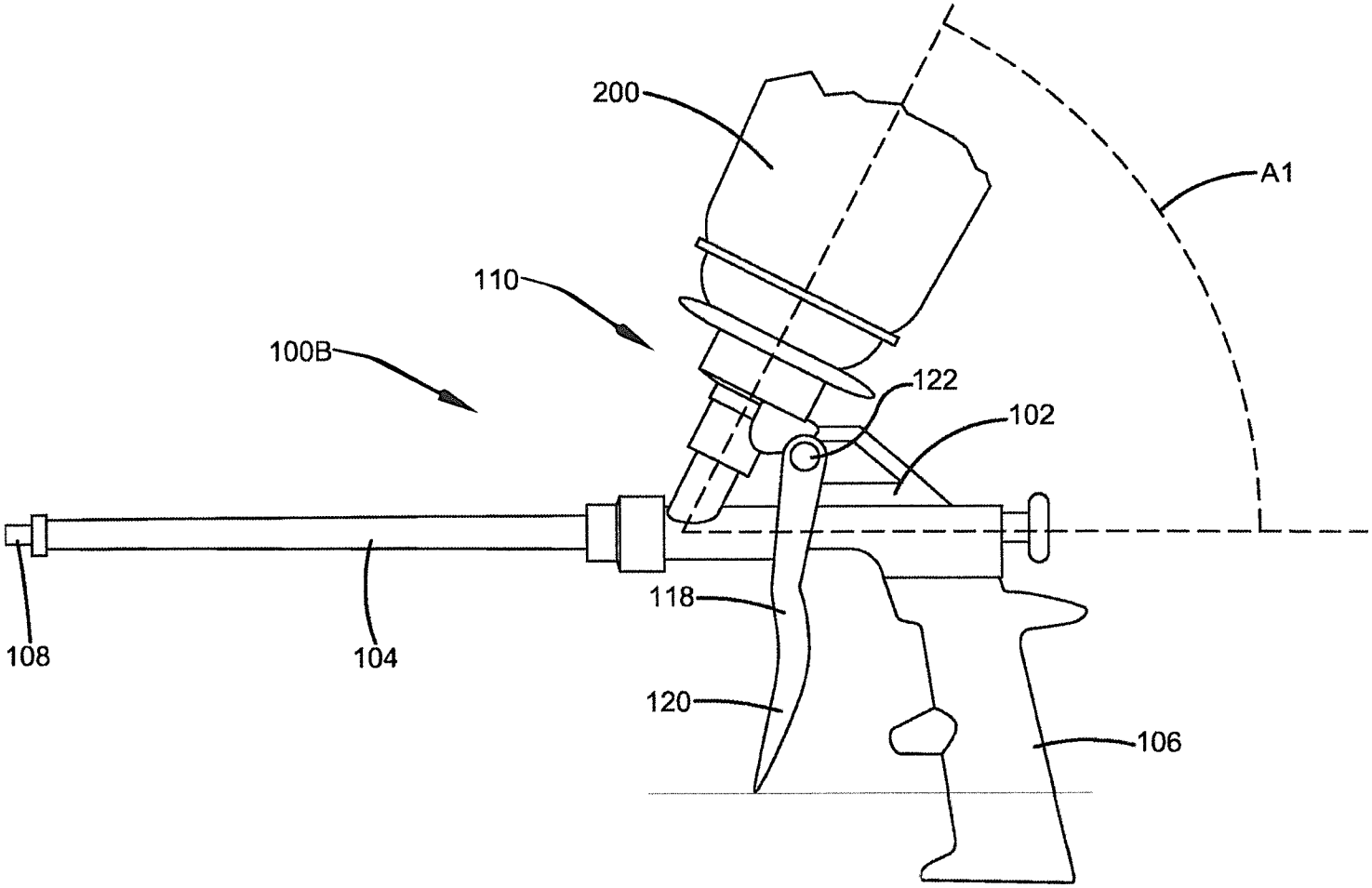
FIG. 10 is a side view of a spray apparatus with a can, only a portion shown, attached to the can receiving portion.

With continued reference to FIGS. 9 and 10, a container receiving portion 110 may be supported to the housing 102 and sized and shaped to securely retain/support a container 10 or 200. For the embodiment seen best in FIG. 9, the container receiving portion 110 may include an outer, generally circular ring 112 defining an opening 114, and a nozzle reception connector 116. The user may attach the pressurized container 10, 200 to the apparatus 100A, 100B, as shown in FIG. 10, such that the nozzle 31, 202 is received within the nozzle reception connector 116 and the valve body 30 or top of can 200 is received within the opening 114. The nozzle reception connector 116 communicates with the fluid passageway in the barrel 104 so that the fluid product within the pressurized container 10, 200 can be dispensed out the tip 108, when desired. For the embodiments shown, the container receiving portion 110 is positioned on a top portion of the apparatus 100A, 100B. As a result, gravity assists in assuring that all the liquid within the container is used. The receiving portion 110 may extend from the apparatus at an angle A1, as shown in FIG. 10, with respect to the longitudinal axis of the housing 102 and/or barrel 104. Angle A1 may be, in one embodiment, between 0 degrees and 90 degrees. In another embodiment, angle A1 may be between 10 degrees and 80 degrees. In yet another embodiment, angle A1 may be between 20 degrees and 70 degrees. For the embodiment shown, angle A1 is approximately 75 degrees.

Still referring to FIGS. 9 and 10, the spray apparatus 100A, 100B may also include a trigger 118 which is moveable relative to the housing 102 in order to deflect the nozzle 31, 202 to dispense the product fluid. The trigger 118 may have a first end with a user contact surface 120 and a second end with a discharge contact surface 122. When the trigger 118 is manually operated, in one embodiment moved, by the user, such as by squeezing the user contact surface 120 toward the handle 106 with the user's hand, the discharge contact surface 122 contacts the nozzle 31, 202 to deflect it and dispense the fluid. The trigger 118 may be moveably attached to the housing 102 in any manner chosen with the sound judgment of a person of skill in the art.

For the embodiment shown in FIG. 9, the second end of the trigger 118 has a U-shaped portion with legs that extend juxtaposed to opposite sides of the housing 102 and pivots about pivot pin 124 which is received through the legs and through the housing 102. In an alternate embodiment, one pivot pin connects one leg to the housing on one side and a second pivot pin connects the other leg to the housing on the opposite side. To provide container size adjustability, an adjustment mechanism 132 may be used. The adjustment mechanism 132 may include bracket 126 that extends from the trigger 118 to a nut 128 that is threadingly received on a threaded rod 130 that is supported to and extending from the housing 102. For the embodiment shown in FIG. 9, the bracket 126 has an opening that receives the pivot pin 124. In an alternate embodiment, another bracket (not visible) extends from the nut 128 to the trigger 118 on the other side of the apparatus 100A. To adjust the apparatus 100A to fit different sized containers, the nut 128 can be rotated about rod 130 to move the bracket 126 and thus the trigger 118 along the longitudinal axis of the housing 102 (that is, along the longitudinal axis of the barrel 104) either closer to the receiving portion 110 or farther away.

With reference again to FIGS. 9 and 10, to use the spray apparatuses 100A, 100B, the user attaches the container 200 or container 10 equipped with the adaptor 20 and valve body 30, to the container receiving portion 110, as explained above. If necessary, the user adjusts the adjustment mechanism 132 to fit the container. The user then only has to position the tip 108 (or other component that is attached to the tip) to the desired location and then move the trigger 118 with respect to the handle 106 (such as by squeezing the trigger 118 toward the handle 106). The trigger 118 movement deflects the nozzle 31, 202 dispensing the fluid out of the container and out of the tip 108.

With reference now to FIGS. 1 and 3, methods of using the fluid dispensing apparatus 50 will now be described. The container 10 may be equipped with container cap 11 by the manufacturer, in one embodiment. The fluid dispensing apparatus 50 may come to the user as a kit, in one embodiment, including the adaptor 20 and the valve body 30. In one embodiment, the adaptor 20 may already be attached to the valve body 30. In another embodiment, the coupling element 22 (see FIG. 4A) is attached to coupling element 33 (see FIG. 7) to attach the adaptor 20 to the valve body 30. In one specific embodiment, this may comprise rotating the adaptor 20 with respect to the valve body 30 with threaded section 59 engaged with threaded section 37 to "tighten" them together. This action may compress seal 24 and a lower service of the valve body 30 may contact surface 51, or come near to contacting it. In another embodiment, the fluid dispensing apparatus 50 may come to the user already attached to the pressurized container 10.

With reference now to FIGS. 1, 3, 4B, 6 and 7, the user then attaches the fluid dispensing apparatus 50 to the container 10. In one embodiment, this means attaching the coupling element 21 of the adaptor 20 (see FIG. 4B) with the coupling element 12 of container 10 (see FIG. 3). In one specific embodiment, this may comprise rotating the fluid dispensing apparatus 50 with respect to the container 10 with threaded section 57 engaged with threaded section 19 to "tighten" them together. This action may compress seal 23. As the fluid dispensing apparatus 50 is attached to the container 10, piercing member 27 (see FIG. 4B) contacts and pierces membrane 15 (see FIG. 3 to see the membrane 15 before it is pierced, and FIG. 6 to see the membrane 15 after it is pierced). Once the membrane 15 is pierced, container bore 14 communicates with adaptor bore 26 which communicates with valve body bore 34. Thus, once the fluid dispensing apparatus 50 is attached to the pressurized container 10, all the user needs to do to dispense the paint is operate nozzle 31, such as by deflecting the nozzle 31, as described above. Thus, operation of the fluid dispensing apparatus 50 with container 10 as shown in FIG. 1 is similar to the use of container 200 and nozzle 202 shown in FIG. 2.

In another embodiment, container 10 may be depressurized and substantially emptied of paint fluid according to the following method. The user may uncouple or detach container 10 from adaptor 20 (and thus from fluid dispensing apparatus 50) and separate the two components. With container 10 separated from adaptor 20, pierced membrane 15 is exposed to the ambient thus resulting in container 10 becoming depressurized. Next, container 10 may be substantially emptied of fluid by placing it with pierced membrane 15 facing down and thus using gravity to force the paint fluid out of container 10. At this point container 10 may be easily deposed of. The fluid dispensing apparatus 50 may then be reused with another container.

Since conventional spray cans include an internal valve, producing such spray cans has typically involved filling the spray cans through the valve, which could then prevent those contents from escaping once filling was complete. However, since the container of the present disclosure lacks an internal valve, the present container must be filled and the container cap installed to seal the interior space of the container without installing a valve.

Figure 16:
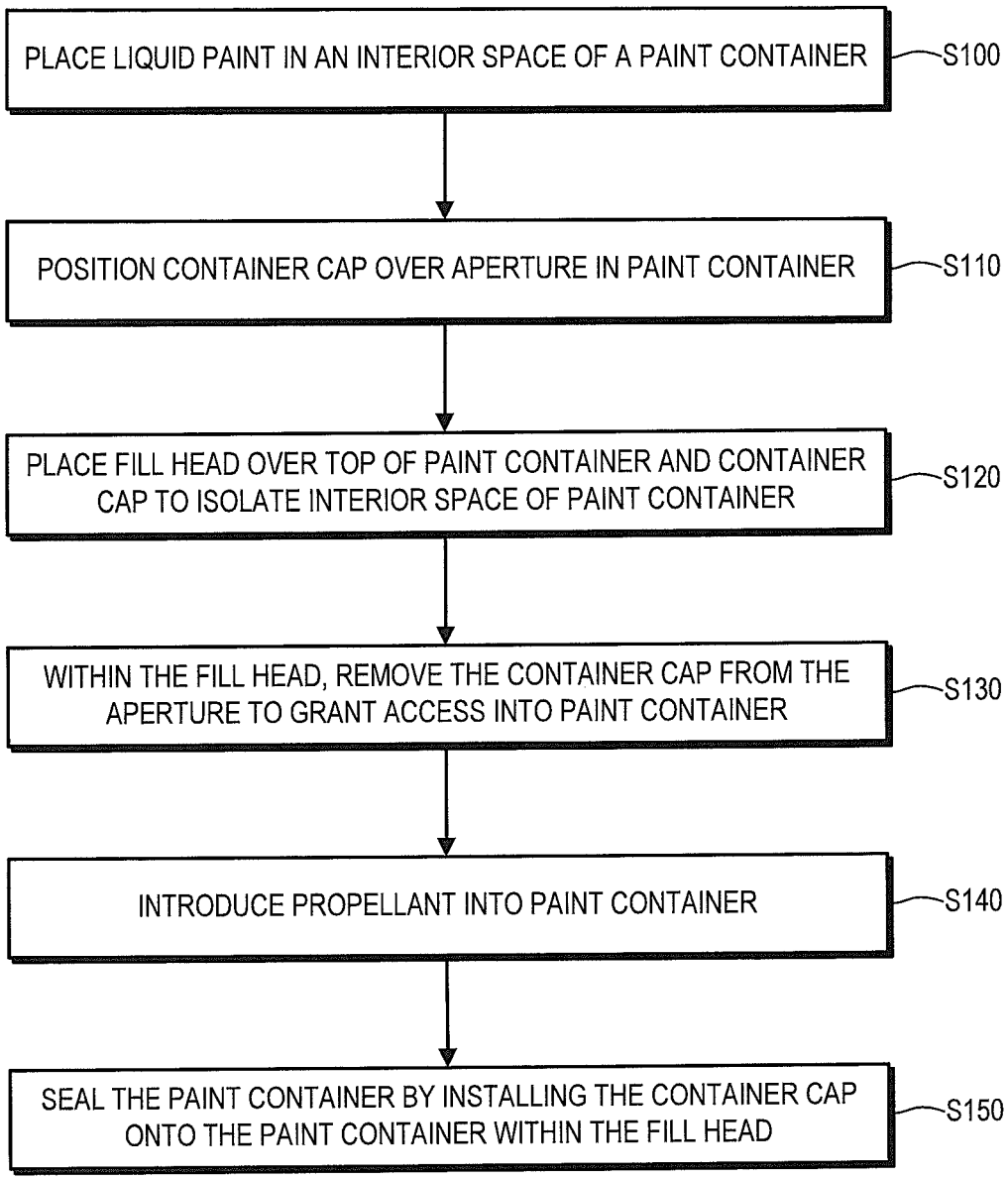
FIG. 16 is a flow diagram schematically representing a method of producing a container in accordance with an embodiment of the present disclosure.
Figure 17:
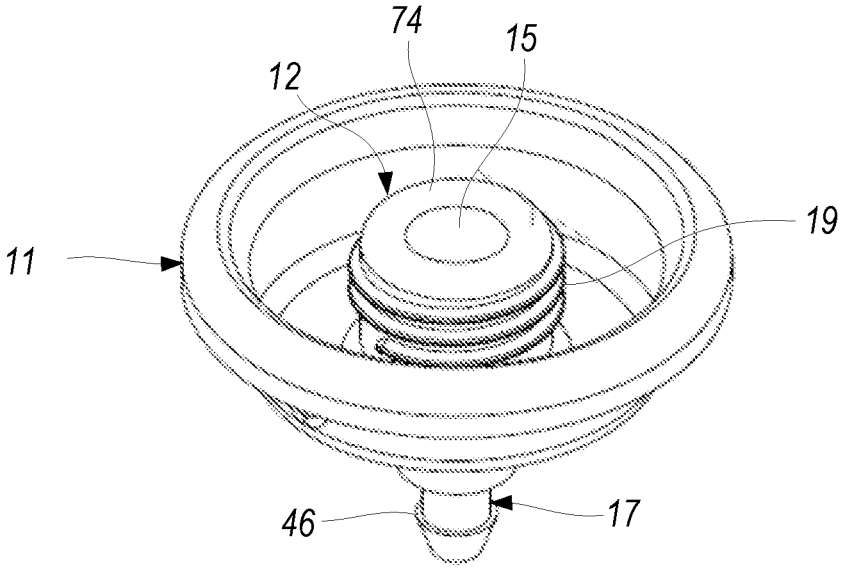
FIG. 17 is a top, perspective view of an illustrative embodiment of a container cap that includes a dip tube through which a liquid product is expelled from a container.

A method of producing a container is schematically depicted in FIG. 16. At step S100, liquid paint is added to the interior space defined by a housing of the container 10 through an aperture defined by a rim of the container 10. The paint can optionally be added to the container 10 under atmospheric pressure before the container cap 11 is positioned adjacent to the aperture defined by the rim at step S110, and optionally before the container 10 is covered by an enclosure for introduction of the propellant as described below. Positioning the container cap 11 at step S110 can optionally include using a mechanical arm or other grasping device to mechanically grasp a handling member 60 projecting from the container cap 11 and, under the control of a programmed computer processor, nearly concentrically aligning the longitudinal axis of the holding member 60 with the aperture defined by the rim. With the handling member 60 aligned with the aperture defined by the rim, the container cap 11 with the handling member 60 can be lowered into place such that the channel 70 receives the rim. Since the handling member 60 does not fully block the bore 14 and prevent paint and propellant from passing through the bore 14, the handling member 60 can remain within the container 10 even though it has already served its purpose to align the container cap 11 over the aperture defined by the rim. Even if the friction fit between the container cap 11 and the handling member 60 allows the handling member 60 to separate from the container cap 11 within the sealed container 10, no degradation of the assembled system is expected.

A containment device such as a filler head is placed over the container cap 11 resting on, or positioned over the rim aperture to form an enclosure in which a pressure above atmospheric pressure can be maintained during introduction of the propellant into the container 10. Since the propellant is volatile, and evaporates at atmospheric pressure, the filler head, containment device or other enclosure can be positioned over a portion of the container 10 comprising the aperture to abut against the container 10 or other structure to form the enclosure in which the elevated pressure can be maintained during introduction of the propellant. The container cap 11 can be separated from the rim if resting thereon at step S130 and, with the enclosure in place over at least a portion of the container 10, a quantity of a propellant is introduced into the interior space of the container 10 through the aperture at step S140. The amount of the propellant introduced is suitable to establish a pressure within the interior space to propel the paint from the container 10. As the fluid is introduced, the pressure within the enclosure rises above atmospheric pressure. While the enclosure is still in place, the container cap 11 is installed on the rim of the container 10 within the enclosure, at step S150, after the propellant has been fully introduced to close the aperture and seal the container 10 to contain the combination comprising the liquid paint and the propellant. The container 10 can then be removed from the containment device after the container cap 11 has been installed to seal the aperture.

Embodiments of the present method allow for the insertion of a split, elastomeric gasket between the container cap 11 and the rim to promote a strong seal. The annular channel 70 extending about a periphery of the container cap 11 is placed on, and receives the rim of the container in a first state, shown in FIG. 17. Without installing a valve within the interior space of the container 10, a collet or other suitable crimping tool can be used to deform the rim of the container 10 within the annular channel 70 as shown in FIG. 18, in which the rim is rolled onto itself within the annular channel 70, as an example of suitable deformation. The deformation of the rim into a second state establishes a friction fit between the annular channel 70 of the container cap 11 and the container 10 suitable to interfere and prevent the escape of significant portions of the propellant between the container cap 11 and the container 10.rim The foregoing description of examples and embodiments have been presented for purposes of illustration and description. It is not intended to be exhaustive or limiting to the forms described. Numerous modifications are possible in light of the above teachings. Some of those modifications have been discussed, and others will be understood by those skilled in the art. The examples and embodiments were chosen and described in order to best illustrate principles of various examples as are suited to particular uses contemplated. The scope is, of course, not limited to the examples and embodiments set forth herein, but can be employed in any number of applications and equivalent devices by those of ordinary skill in the art. It will be apparent to those skilled in the art that the above methods and apparatuses may incorporate changes and modifications without departing from the general scope of this invention. It is intended to include all such modifications and alterations.

We claim:

1. A fluid storage system comprising:

a container defining an interior space that lacks an internal valve;

a product and a propellant stored under pressure within the interior space; and a container cap coupled to the container to enclose the container and maintain the product and the propellant within the interior space of the container, the container cap comprising:

a coupling element that defines a fluid passage bore, the coupling element comprises an externally threaded section, a collar, a well disposed between the coupling element and the collar, defining a downward-opening, annual channel, a membrane enclosing a first end of the fluid passage bore defined by the coupling element that seals the product and the propellant within the interior space of the container, the externally threaded section engages a compatible fastener provided to a reusable dispensing apparatus to releasably couple the reusable dispensing apparatus to the container cap wherein the membrane is pierced by a portion of the reusable dispensing apparatus when the reusable dispensing apparatus is installed on the container cap to establish fluid communication between the interior space and the reusable dispensing apparatus and establish a seal that interferes with an escape of the propellant between the container cap and the reusable dispensing apparatus after the membrane has been pierced, and a dip tube comprising a proximate end arranged adjacent to the fluid passage bore defined by the coupling element, and a distal end that protrudes in a direction away from the container cap, into the interior space defined by the container, wherein the dip tube defines an interior passage extending between the proximate end and the distal end through which the product is to travel to be expelled from the container through the container cap and the reusable dispensing apparatus by the propellant.

2. The fluid storage system of claim 1, wherein the distal end of the dip tube is supported at a vertical elevation within the interior space of the container that is closer to a floor of the container than a vertical elevation of the proximate end of the dip tube adjacent to the fluid passage bore.

3. The fluid storage system of claim 1 further comprising an extension tube comprising a first end defining an aperture that cooperates with a portion of the distal end of the dip tube to couple the extension tube to the dip tube, establishing fluid communication between a second end of the extension tube and the distal end of the dip tube.

4. The fluid storage system of claim 3, wherein the dip tube further comprises a barb adjacent to the distal end of the dip tube.

5. The fluid storage system of claim 4, wherein the barb comprises a tapered region and a flange, wherein the first end of the extension tube extends over the tapered region to the flange.

6. The fluid storage system of claim 3, wherein the extension tube extends an entire distance between the dip tube and a floor of the container, and supports the second end of the extension tube adjacent to the floor of the container.

7. The fluid storage system of claim 1 further comprising an extension tube formed as a portion of a monolithic structure with the dip tube, wherein the extension tube extends an entire distance between the dip tube and a floor of the container, and supports an end of the extension tube adjacent to the floor of the container.

8. The fluid storage system of claim 1, wherein the proximate end of the dip tube extends at least partially into the fluid passage bore defined by the coupling element.

9. A process of dispensing a product from a container, the process comprising:

introducing a fluid dispensing apparatus comprising a valve to a coupling element provided to a container cap, wherein the container cap: (i) encloses the product and a propellant in an interior space of the container that is devoid of an internal valve, and (ii) supports a dip tube that protrudes in a direction from the container cap into the interior space of the container, wherein an extension tube extends from a distal end of the dip tube toward a floor of the container, introducing the fluid dispensing apparatus comprises releasably coupling the fluid dispensing apparatus onto an externally threaded section of a coupling element that defines a fluid passage bore of the container cap, and establishing a seal that interferes with an escape of the propellant between the container cap and the fluid dispensing apparatus, the container cap comprises a collar, and a well disposed between the coupling element and the collar, defining a downward-opening, annual channel;

puncturing a membrane provided to the container cap to establish fluid communication between the fluid dispensing apparatus and the interior space of the container, forming an interior passage through which the product is to travel from the interior space of the container to the fluid dispensing apparatus; and dispensing the product from the container through the fluid dispensing apparatus while the container is in an upright orientation, by actuating the valve provided to the fluid dispensing apparatus, causing a portion of the product pooled at the floor of the container in the upright orientation to be expelled by the propellant through the fluid dispensing apparatus.

10. The process of dispensing the product of claim 9, wherein introducing the fluid dispensing apparatus to the container comprises pivotally adjusting the fluid dispensing apparatus relative to the container, causing engagement between the threaded section of the container cap, and a compatible threaded portion of the fluid dispensing apparatus.

11. The process of dispensing the product of claim 9, wherein introducing the fluid dispensing apparatus comprises compressing a gasket between a portion of the container cap and a portion of the fluid dispensing apparatus to interfere with an escape of the product between the container cap and the fluid dispensing apparatus.

12. The process of dispensing the product of claim 9, wherein dispensing the product from the container comprises causing the product to enter an end of the extension tube adjacent to the floor, and travel through the dip tube and the fluid dispensing apparatus.

13. The fluid storage system of claim 1, further comprising:

an elevated region that protrudes upward from the coupling element; and wherein the membrane is disposed at an end of the protruding region.

14. The fluid storage system of claim 13, the elevated region further comprises a sealing surface.

* * * * *